United States Patent [19]

Linka et al.

[11] 4,073,319

[45] Feb. 14, 1978

[54] SHUTTLE MONITORING DEVICE, PARTICULARLY FOR MULTIPLE-SHUTTLE WEAVING MACHINES

[75] Inventors: Adolf Linka, Hechingen-Sickingen; Gerhard Hamma, Spaichingen, both of Germany

[73] Assignee: Mayer & Cie, Tailfingen, Germany

[21] Appl. No.: 725,529

[22] Filed: Sept. 22, 1976

[30] Foreign Application Priority Data

Oct. 4, 1975 Germany ..... 2544530

[51] Int. Cl.[2] ..... D03D 49/44; D03D 51/40; D03D 47/26

[52] U.S. Cl. ..... 139/134; 139/341; 139/436

[58] Field of Search ..... 139/134, 341–343, 139/436

[56] References Cited

U.S. PATENT DOCUMENTS

| | | | |
|---|---|---|---|
| 2,713,876 | 7/1955 | Walton | 139/134 |
| 2,781,794 | 2/1957 | Bordewieck et al. | 139/341 |
| 3,114,398 | 12/1963 | Pfarrwaller | 139/134 X |
| 3,618,640 | 11/1971 | Linka | 139/134 |

FOREIGN PATENT DOCUMENTS

| | | | |
|---|---|---|---|
| 2,268,887 | 11/1975 | France | 139/134 |
| 1,428,164 | 3/1976 | United Kingdom | 139/134 |

*Primary Examiner*—James Kee Chi

*Attorney, Agent, or Firm*—Michael J. Striker

[57] ABSTRACT

Each shuttle of a multiple-shuttle weaving machine is provided with at least one shuttle magnet. A drive unit acts upon each shuttle magnet to effect positive magnetic transport of the shuttle through the length of the shed, without physically contacting the shuttle. The shuttle monitoring device includes a magnetic-field-dependent resistor for each shuttle to be monitored. The magnetic-field-dependent resistor is moved in parallel to and in synchronism with the drive unit for the shuttle and moves in a region where the resistor is influenced by at least one pole of the shuttle magnet. A machine shut-off device is connected to the resistor and is operative for shutting off the drive units for the shuttles of the weaving machine in response to a resistance change of the magnetic-field-dependent resistor indicative of lack of proper shuttle movement.

8 Claims, 2 Drawing Figures

SHUTTLE MONITORING DEVICE, PARTICULARLY FOR MULTIPLE-SHUTTLE WEAVING MACHINES

BACKGROUND OF THE INVENTION

The invention relates to a shuttle monitoring device, particularly for multi-shuttle weaving machines with positively driven shuttles provided with magnets.

The invention is particularly applicable to multi-shuttle weaving machines having shuttles provided with permanent magnets of alternating polarity arranged in succession, with a multi-pole magnetic guide field being moved along the warp surface and causing the shuttle with its permanent magnets to be carried along its proper path, the guide field being established by corresponding magnets of alternating polarity arranged in succession.

With weaving machines it is advantageous to monitor the travel of the shuttles which serve as the weft yarn inserting means, during the weft yarn insertion operation, in order to immediately shut down the weaving machine upon the detection of irregularities in shuttle movement, before a weft yarn break or other malfunction or even damage to the fabric being woven or to the weaving machine itself can occur.

In the case of shuttles which are thrown through the shed, i.e., in contrast to those which are positively transported through the entire length of the shed, it is already known to monitor the velocity of the shuttle upon the insertion of a weft yarn, in order to be able to derive indications of malfunction from velocity deviations. In that case, the shuttles are provided with permanent magnets which move past an inductive transducer. Such a shuttle monitoring device is not suited for weaving machines, especially multi-shuttle weaving machines, in which the shuttles are positively transported through the entirety of the shed and are not merely thrown through.

SUMMARY OF THE INVENTION

It is an object of the invention to provide a shuttle monitoring device for weaving machines of the type whose shuttles are positively transported through the shed, so designed that a shifting of the shuttles out of their normal or proper positions, for example a shifting in the direction of their movement, is registered and effects a shut-off of the weaving machine.

This object, and others which will become more understandable from the description, below, of preferred embodiments, can be met, according to one advantageous concept of the invention by associating a respective one of a plurality of magnetic-field-dependent resistors with corresponding ones of the plurality of shuttles. The magnetic-field-dependent resistors are movable in parallel synchronized with the drive movement for the positively driven shuttles. The magnetic-field-dependent resistors are provided in the effective region of at least one pole of a respective shuttle magnet and are connected to a shutoff device for the weaving machine. A shuttle monitoring device according to the invention is particularly well suited for use in multiple-shuttle weaving machines whose shuttles are moved by a moving magnetic guide field, with at least one magnetic-field-dependent resistor being provided in each shuttle guide region of the weaving machine. The magnetic-field-dependent resistor is arranged intermediate two opposite-polarity magnetic poles of the magnetic guide field and, in common with the magnetic-field-dependent resistors of the other shuttle monitoring devices, can be switched into the control circuit of a shut-off device for the weaving machine. When used in such a weaving machine, no specially provided control magnets need be employed for the shuttle monitoring devices; instead, the shuttle monitoring devices operate by means of magnetic fields produced by the magnets which are anyway present for effecting the guidance and transport of the shuttles.

For the magnetic-field-dependent resistors, use is preferably made of at least one Hall generator per shuttle to be monitored. The spacing of the one or more Hall generators from the guided side of the shuttle can be greater than the distance from this guided side of the magnetic poles producing the shuttle guide field. The Hall generators advantageously form the branches of a voltage divider whose tap is connected with the first input of a voltage comparison stage. The second input of the voltage comparison stage has applied to it an adjustable reference voltage, and its output controls the conductivity of an electronic switch connected in the energizing current path of the switching relay for effecting shut-down of the weaving machine. For the magnetic-field-dependent resistors, use could also be made of two Hall generators per shuttle to be monitored, the two Hall generators being connected in series across a stabilized D.C. voltage and together forming a voltage divider.

Shuttle monitoring devices according to the present invention have the advantage of requiring little room at the location where the shuttle movement is to be monitored, and are furthermore very reliable in operation. This is because they operate without physically contacting the shuttle and have sensing means which are operative right through the weft yarns without being affected in their operation by flying yarn pieces or other depositions of contaminants, or the like. Additionally, the shuttle monitoring device can be adjusted very exactly and sensitively, so that even very small undesired shifting of the shuttles in their guide paths can be determined and result in automatic shut-down of the weaving machine, before as a result of such shifting breakage of the weft yarn can occur or other malfunctions be produced. The sensitivity of response of the shuttle monitoring device can if desired be adjusted in correspondence to the type of yarn being employed as well as other factors. To this end, the reference voltage can be set on a potentiometer whose adjusting means, e.g., a wiper, is readily accessible from the exterior of the weaving machine.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
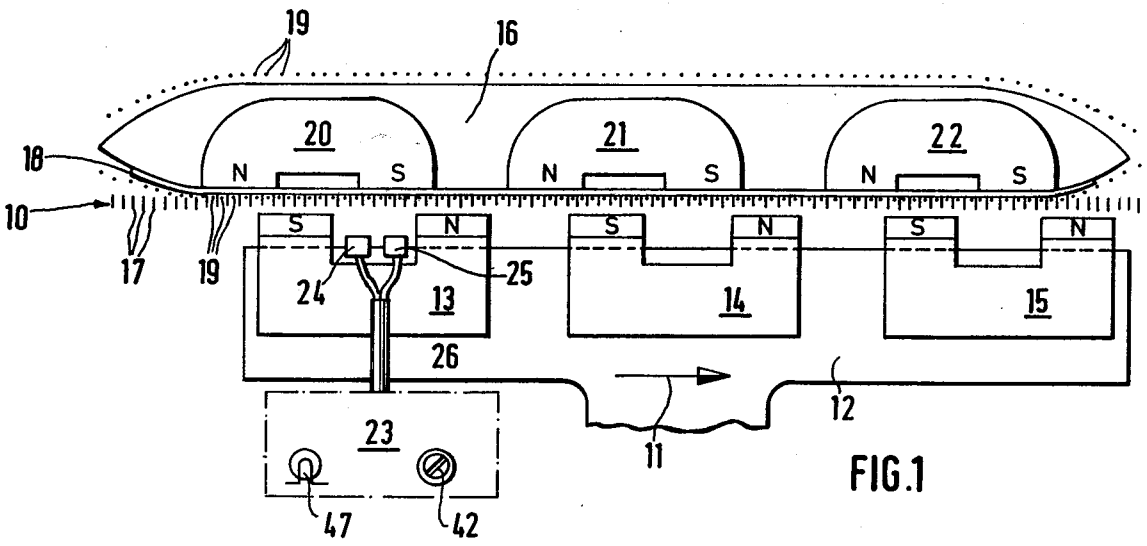
FIG. 1 schematically depicts an electromagnetically driven shuttle of a multiple-shuttle weaving machine as well as a shuttle monitoring device illustrative of the invention.

FIG. 1 shows in section a stationary reed 10, a carrier 12 movable in the direction of arrow 11 and provided with three equally spaced permanent horseshoe magnets 13, 14, 15, as well as a shuttle 16 of a multi-shuttle weaving machine of the type provided with electromagnetic shuttle drive means. The reed dents 17 with their one side form the race for the shuttles 16 which with their sliding surface 18 made of friction-reducing material lie against the reed dents 17. The warp yarns 19 moved for the formation of the shed are pressed by the shuttles between the reed dents 17, which prevent a sideward shifting of the warp yarns upon the through-passage of the shuttle.

Arranged in the shuttle 16 which slides along the reed 10 are three permanent horseshoe magnets 20, 21, 22 which corresponds to the drive magnets 13–15 of the carrier 12 located behind reed 10, with respect to the distribution, distances between opposite polarity poles, and pole spans, but having poles each of which is of a polarity opposite to that of the corresponding pole of the respective one of drive magnets 13–15. As the carrier is pushed through the weaving machine, the magnetic field established by its permanent horseshoe magnets 13–15 pulls the shuttle along, so that the shuttle 16 is positively pulled through the shed during the entirety of its travel therethrough, and is not merely thrown through the shed to travel freely therethrough. A shuttle drive of this type and the type of shuttle guidance in question are disclosed, for example, in U.S. Pat. No. 3,618,640.

In the region of each shuttle 16 of the multipleshuttle weaving machine, in which in per se known manner a plurality of shuttles are simultaneously moved spaced in succession from one another, there is arranged a housing 23. Housing 23 contains the circuit components of a shuttle monitoring device. The shuttle monitoring device includes two Hall generators 24, 25 arranged between the north pole leg and the south pole leg of the horseshoe-shaped drive magnet 13. The Hall generators 24 and 25 are spaced from the reed 10 by a distance greater than are the two pole legs of the magnet 13. The Hall generators 24, 25 are connected via an electrical connecting cable 26 with the circuit components in the interior of the housing 23 of the shuttle monitoring device.

Figure 2:
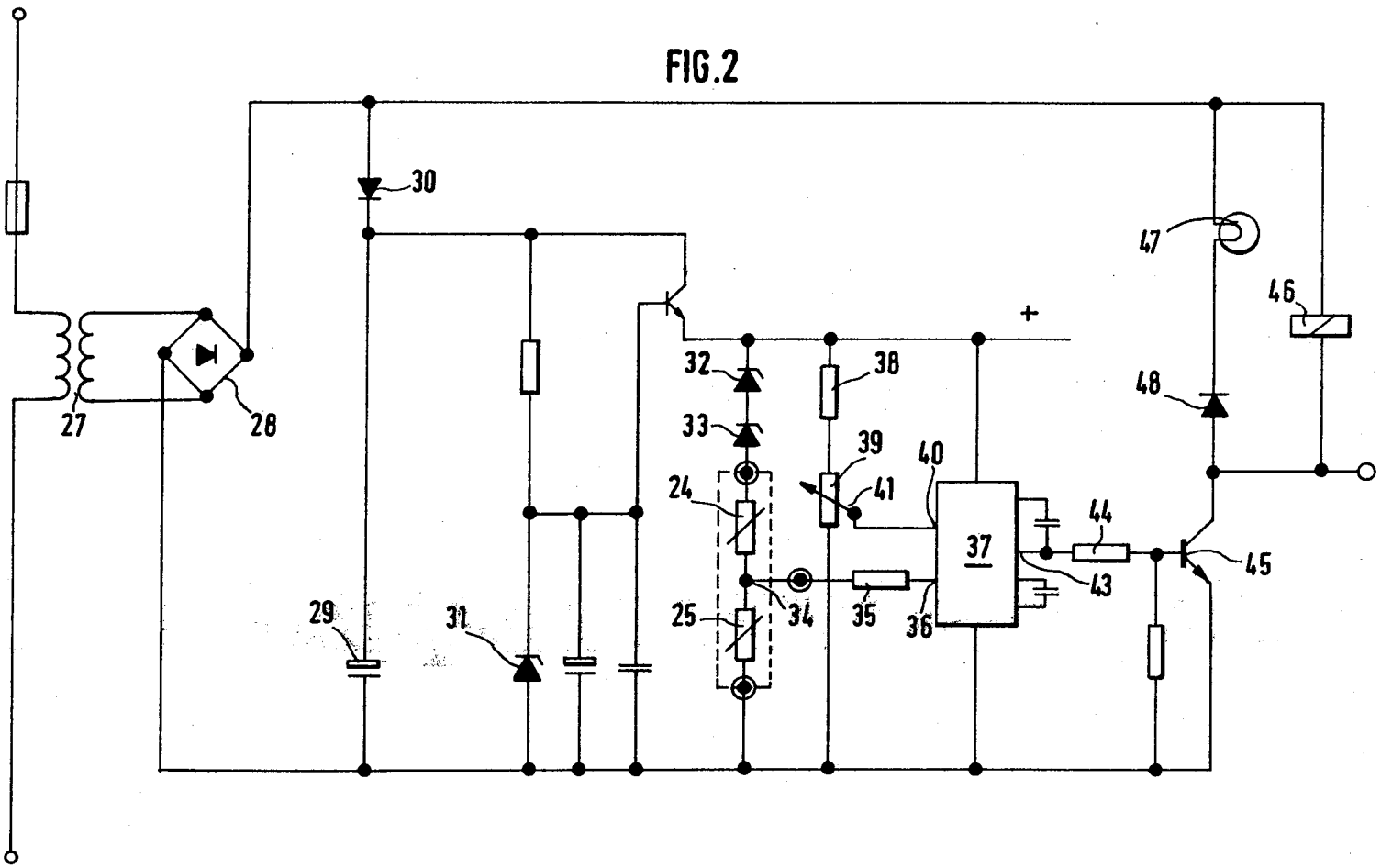
FIG. 2 depicts the electrical circuitry of the illustrative shuttle monitoring device.

FIG. 2 depicts the electrical circuitry of the shuttle monitoring device. Each one of the plurality of shuttle monitoring devices of the machine is energized by D.C. current via a transformer 27 and a bridge rectifier 28 connected to the output of the transformer 27. The supply of current to the carrier 12 containing the shuttle monitoring device housing 23 with the circuit elements thereof is effected by means of slip rings not illustrated in the drawing. The control circuit includes a buffer capacitor 29 and a diode 30 which prevent discharging of the smoothened D.C. voltage which is stabilized at a predetermined voltage value by means of a zener diode 31.

The voltage applied to the two Hall generators 24, 25 is further stabilized by means of two further zener diodes 32, 33. The two Hall generators are connected in series to form a voltage divider, the junction 34 of which is connected via a resistor 35 to the first input 36 of an operational amplifier connected to operate as a voltage comparison stage 37. Connected in parallel to the voltage divider formed by the two Hall generators 24, 25 is a second voltage divider formed by a fixed resistor 38 and a potentiometer 39. The wiper 41 of the potentiometer 39 furnishes a preadjustable reference voltage. The adjusting member 41 of the potentiometer 39 can be manually activated from the exterior of the housing 23 of the shuttle monitoring device by means of an adjusting screw 42 located on the outside of housing 23. In this way it is possible to change the reference voltage and accordingly change the response value or sensitivity of the shuttle monitoring device as needed.

The output 43 of the voltage comparison stage 37 is connected via a resistor 44 to the base of a transistor 45. The collector-emitter path of transistor 45 forms part of the current path of a relay winding 46. Relay winding 46 cooperates with a (non-illustrated) reed contact to form a reed switching relay assuring a fast response. Connected in parallel to switching relay winding 46 is an indicator lamp 47 provided with a rectifying diode 48.

When the shuttle 16 is laid upon its raceway as shown in FIG. 1, it will be held against the reed 10 by the drive magnets 13-15 of the carrier 12, and the magnetic circuit of the drive magnets 13-15 is closed by way of the shuttle 16 itself and its permanent magnets 20-22. When the magnetic circuit of permanent magnet 13 is closed, the two Hall generators 24, 25 are penetrated by only a few lines of stray flux. In contrast, if the shuttle 16 is removed or if it shifts in its direction of movement to one or the other side, so that one or both poles of the shuttle magnet 20 finds itself in the region of an opposite-polarity pole of the drive magnet 13, then the magnetic circuit of the drive magnet 13 will be closed via a path extending more or less substantially through the intermediate space between the two pole legs of magnet 13, where the two Hall generators 24, 25 are located. Now, as a result of the stronger density of the magnetic flux passing through the Hall generators 24, 25, their electrical resistance will undergo a change leading to an increase of the voltage being applied to the first input 36 of the voltage comparison stage 37. The voltage comparison stage 37 is so designed and dimensioned that, upon the occurrence of an increase of the voltage at the first input 36 to a value above that of the reference voltage applied to second input 40, a positive signal appears at the output 43. This positive signal renders conductive the transistor 45. The indicator lamp 47 lights up and provides an indication of which one of the plurality of shuttles 16 has slipped or shifted, and the relay winding 46 becomes energized, causing the weaving machine to be brought to a standstill.

All the plurality of shuttle monitoring devices could operate upon a shared switching relay to which the individual shuttle monitoring devices would be connected via an OR-stage. The shuttle monitoring device can be used in a similar fashion when the shuttles 16 are mechanically driven, where to this end the drive components and shuttles would be provided with permanent magnets. In the illustrated embodiments, a very important advantage is that the shuttle monitoring device utilizes for its operation those magnets which are anyway provided for effecting the driving and the guidance of the shuttle, so that the use of additional magnets or specially provided magnets not anyway present is unnecessary. The shuttle monitoring device need not be comprised of two Hall generators; instead, a single Hall generator could be employed.

It will be understood that each of the elements described above, or two or more together, may also find a useful application in other types of circuits and constructions differing from the types described above.

While the invention has been illustrated and described as embodied in a multi-shuttle weaving machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a weaving machine, particularly a multiple-shuttle weaving machine, of the type in which the shuttle is provided with at least one shuttle magnet, and in which magnetic drive means moves along the shed and acts upon the shuttle magnet to effect positive magnetic transport of the shuttle through the shed, a shuttle monitoring device, the shuttle monitoring device comprising, in combination, a magnetic-field-dependent resistor for each shuttle to be monitored; means for transporting the magnetic-field-dependent resistor in parallel with and in synchronism with the drive means and in a region where the resistor is influenced by at least one pole of the shuttle magnet during the entire transport of the shuttle through the shed, whereby during transport of the shuttle through the shed the magnetic-field-dependent resistor will remain in a predetermined position relative to the at least one pole of the shuttle magnet so long as a predetermined relative position between the magnetic drive means and the at least one shuttle magnet is being maintained; and machine shutoff means connected to the resistor and operative for shutting off the drive means for the weaving machine in response to a resistance change of the resistor indicative of improper relative position between the drive means and the shuttle magnet and thus lack of proper shuttle movement.

2. The machine defined in claim 1, each shuttle of the weaving machine being provided with a succession of permanent magnet poles of alternating polarity, the drive means for each shuttle comprising means for producing a corresponding multi-pole magnetic guide field translatable along the length of the weft surface to produce synchronous movement of the shuttle, the magnetic guide field having poles of a spacing and alternation corresponding to that of the permanent magnet poles of the shuttle, the means for transporting the magnetic-field-dependent resistor comprising means mounting the latter on the respective shuttle drive means intermediate two opposite-polarity magnetic poles of the guide field, the machine shut-off means comprising a machine shut-off circuit, the magnetic-field-dependent resistors associated with the shuttles being connected in common in the machine shut-off circuit.

3. The machine defined in claim 2, the magnetic-field-dependent resistor being each comprised of at least one Hall generator, the spacing of the Hall generator from the guided side of the respective shuttle being greater than the spacing of the magnets producing the poles of the guide field from the guided side of the respective shuttle.

4. The machine defined in claim 1, each shuttle of the machine being provided with a respective voltage comparison stage having first and second inputs and an output, a source of an adjustable reference voltage, and an electronic switch, each magnetic-field-dependent resistor forming part of a respective voltage divider whose tap is connected to the first input of the voltage comparison stage, the second input of the voltage comparison stage being connected to receive the adjustable reference voltage, the output of the voltage comparison stage being connected to and controlling the electronic switch, the electronic switch being connected in the energizing current path of a switching relay and the latter being activatable for effecting machine shutdown.

5. The machine defined in claim 4, each magnetic-field-dependent resistor being comprised of two Hall generators connected in series to form the respective voltage divider, and means connected in series with the respective voltage divider for effecting the application thereto of a stabilized D.C. voltage.

6. The machine defined in claim 4, each source of the adjustable reference voltage being provided with means accessible from the exterior of the weaving machine for selecting the value of the reference voltage.

7. The machine defined in claim 4, further including an indicating lamp connected in parallel to the switching relay.

8. The machine defined in claim 4, the switching relay being a reed contact relay.

* * * * *